United States Patent [19]

Schifrin

[11] Patent Number: 4,895,250

[45] Date of Patent: Jan. 23, 1990

[54] QUICK ASSEMBLY AND KNOCK-DOWN BOX AND OIL RECYCLING KIT USING SAME

[76] Inventor: Arthur Schifrin, 4652 Via Marina, Marina Del Rey, Calif. 90292

[21] Appl. No.: 206,419

[22] Filed: Jun. 14, 1988

[51] Int. Cl.[4] ..... B65D 5/48; B65D 81/36; F16N 33/00

[52] U.S. Cl. ..... 206/223; 229/120.35; 229/120.36; 229/117; 220/404

[58] Field of Search ..... 229/120.23, 120.35, 229/120.36, 120.38, 41 B; 206/223; 220/404

[56] References Cited

U.S. PATENT DOCUMENTS

| | | | |
|---|---|---|---|
| 1,162,887 | 12/1915 | Streit | 229/120.35 |
| 1,990,829 | 2/1935 | Jensen | 229/120.35 |
| 2,327,709 | 8/1943 | Himes | 229/41 B |
| 3,494,536 | 2/1970 | Henry | 229/41 B |
| 3,757,990 | 9/1973 | Buth | 206/223 X |
| 3,960,313 | 6/1976 | Sax et al. | 229/41 B |
| 4,098,398 | 7/1978 | Meyers | 220/404 X |
| 4,186,955 | 2/1980 | Campbell | 206/223 X |
| 4,283,032 | 8/1981 | Smith | 206/223 X |
| 4,512,463 | 4/1985 | Ward | 206/223 X |

*Primary Examiner*—Arnold Rosenthal
*Attorney, Agent, or Firm*—Lilling & Greenspan

[57] ABSTRACT

Quick assembly and knock-down box has a lower open end which closes upon opening or assembly of the box by having two pairs of adjacent closing panels connected to each other and having configurations and fold lines to cause the closing panels to unfold to positions where all closing panels mesh or mate to form a substantially closed bottom wall suitable for supporting a plastic liner filled with liquid such as oil. The blank for the box and the oil recycling kit which incorporates the box are described.

7 Claims, 4 Drawing Sheets

FIG.1
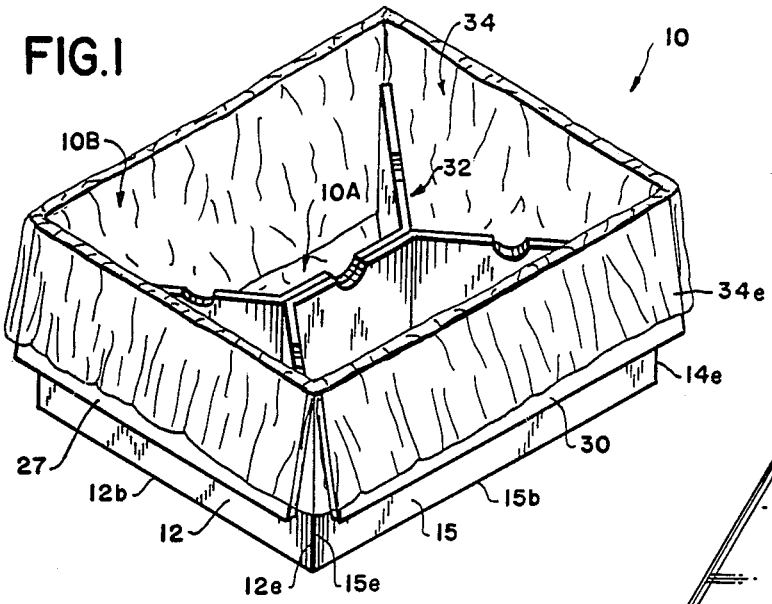
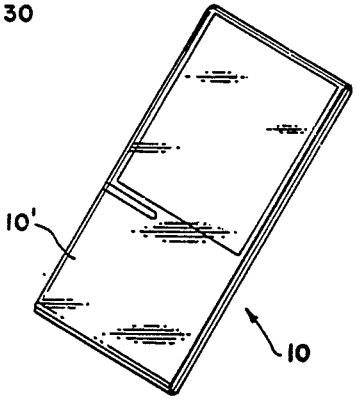
FIG.2
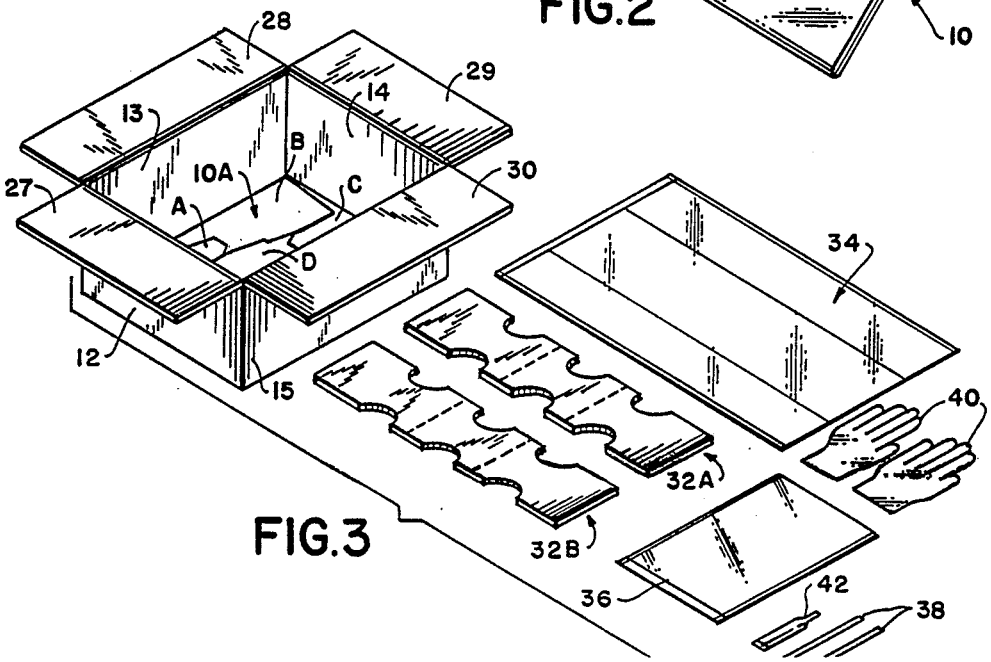
FIG.3

QUICK ASSEMBLY AND KNOCK-DOWN BOX AND OIL RECYCLING KIT USING SAME

BACKGROUND OF THE INVENTION

1. Field of the Invention

This invention generally relates to automobile maintenance aids, and more specifically, to an oil changing or recycling kit which makes it possible to change the oil in an automobile in a safe, inexpensive and effective manner.

2. Prior Art of the Invention

While numerous aids have been made available to automobile owners for making minor repairs and maintaining their automobiles, most "do it yourselfers" have been reluctant to change the oil and oil filter on an automobile. Although changing the oil and oil filter is probably one of the most frequently required maintenance functions to be performed on automobiles, it has normally been avoided for lack of suitable means for disposing the old oil. Also, most car owners do not have suitable container for receiving the old oil to be replaced that can also be disposed in a safe manner. This has particularly been a problem since motor oil is generally considered to be a hazardous waste which cannot simply be casually discarded.

Oil changing kits have been made available to automobile owners, which typically include an assembled three-dimensional cardboard box which is appropriately sealed, such as with a plastic liner, for retaining oil placed therein. However, such oil kits include assembled containers which take up a substantial amount of storage space. Accordingly, such known oil changing kits have been expensive to ship, store and display.

SUMMARY OF THE INVENTION

It is, accordingly, a primary object of the present invention to provide a knock-down version of an oil recovery kit which saves a significant amount of valuable store space.

It is another object of the present invention to provide an oil recovery kit of the type under discussion which occupies a significantly smaller volume of space and, therefore, shipping becomes much less of a problem and less costly.

It is still another object of the present invention to provide an oil recovery or recycling kit of the type above suggested which, despite the smaller volume occupied during shipment and storage, provides all of the functions and features of existing fully assembled oil recovery containers.

It is yet another object of the present invention to provide an oil recycling kit of the type aforementioned which is particularly adapted to be brought to a recycling collection center and, therefore, generally complies with federal and state hazardous waste disposal laws and regulations.

In order to achieve the above objects, as well as others which will become apparent hereafter, a quick assembly and knock-down box in accordance with the present invention comprises, in the assembled condition, first, second, third and fourth generally rectangular side walls, each having a pair of spaced substantially parallel end edges and a pair of spaced substantially parallel top and bottom edges. Adjacent side walls are connected to each other at associated end edges. Said first and third side walls having substantially the same dimensions, and said second and fourth side walls having substantially the same dimensions. Said side walls are arranged to define a generally rectangular space defined by spaced parallel first and third side walls which are substantially normal to spaced parallel second and fourth side walls. A bottom wall formed by first, second, third and fourth bottom panels are connected to associated ones of said bottom edges of said first, second, third and fourth side walls, respectively. Said first and third bottom panels have substantially the same dimensions and said second and third bottom panels have substantially the same dimensions. Said second and fourth bottom panels each have a connecting panel portion moyable out of the planes of respective second and fourth bottom panels along weakened or fold lines. Said second bottom panel connecting panel portion is fixedly joined to said first bottom panel and said fourth bottom panel connecting panel portion is fixedly joined to said third bottom panel. Said top edges of said side walls define an opening into said rectangular space. Said bottom panels are configurated to form a substantially closed bottom wall in the assembled condition and to retract between said side walls in a collapsed condition of the box wherein one of two pairs of two adjacent side walls are disposed in one of two proximate parallel planes to form a substantially coplanar assembly in the knock-down condition of the box.

A blank in accordance with the present invention comprises a longitudinal row of successively arranged generally rectangular first, second, third and fourth side walls. Adjacent ones of said side walls are joined at generally transverse fold lines, said side walls being bounded by spaced parallel elongate fold lines normal to said transverse fold lines. One elongate fold line defines top edges of said side walls and the other elongate fold line defines bottom edges of said side walls. The construction or arrangement of the various panels, walls, etc. are generally as above described for the box. An oil changing and recycling kit in accordance with the present invention includes the box as aforementioned, and an inside liquid impervious bag for lining the interior of the box and providing a liquid seal to insure that oil received within the rectangular space is retained inside said bag. Closure means is provided for closing the inside bag after it is filled with oil, such as a twist tie.

In accordance with another feature of the present invention, baffle means is provided within the rectangular space to limit liquid movements or sloshing within the box, and the kit may further be provided with a filter bag for disposal of oil filter, as well as protective gloves and hand cleaner.

BRIEF DESCRIPTION OF THE DRAWINGS

The foregoing and other important objects of the present invention will become more apparent during the following disclosure which will be made by reference to the drawings, in which:

FIG. 1 is a perspective view of a quick assembly and knock-down box in accordance with the present invention, as shown with the internal plastic liner or inside bag for receiving oil, and the internal baffle for preventing excessive liquid movements or sloshing of the oil within the box;

FIG. 2 is a perspective view of the oil changing or recycling kit in accordance with the present invention, in its collapsed condition during shipment, storage and display;

FIG. 3 is an exploded view of the kit shown in FIG. 2, in perspective, showing all of the elements or components of the oil changing kit, and showing the box in its assembled condition;

DESCRIPTION OF THE PREFERRED EMBODIMENT

Figure 4:
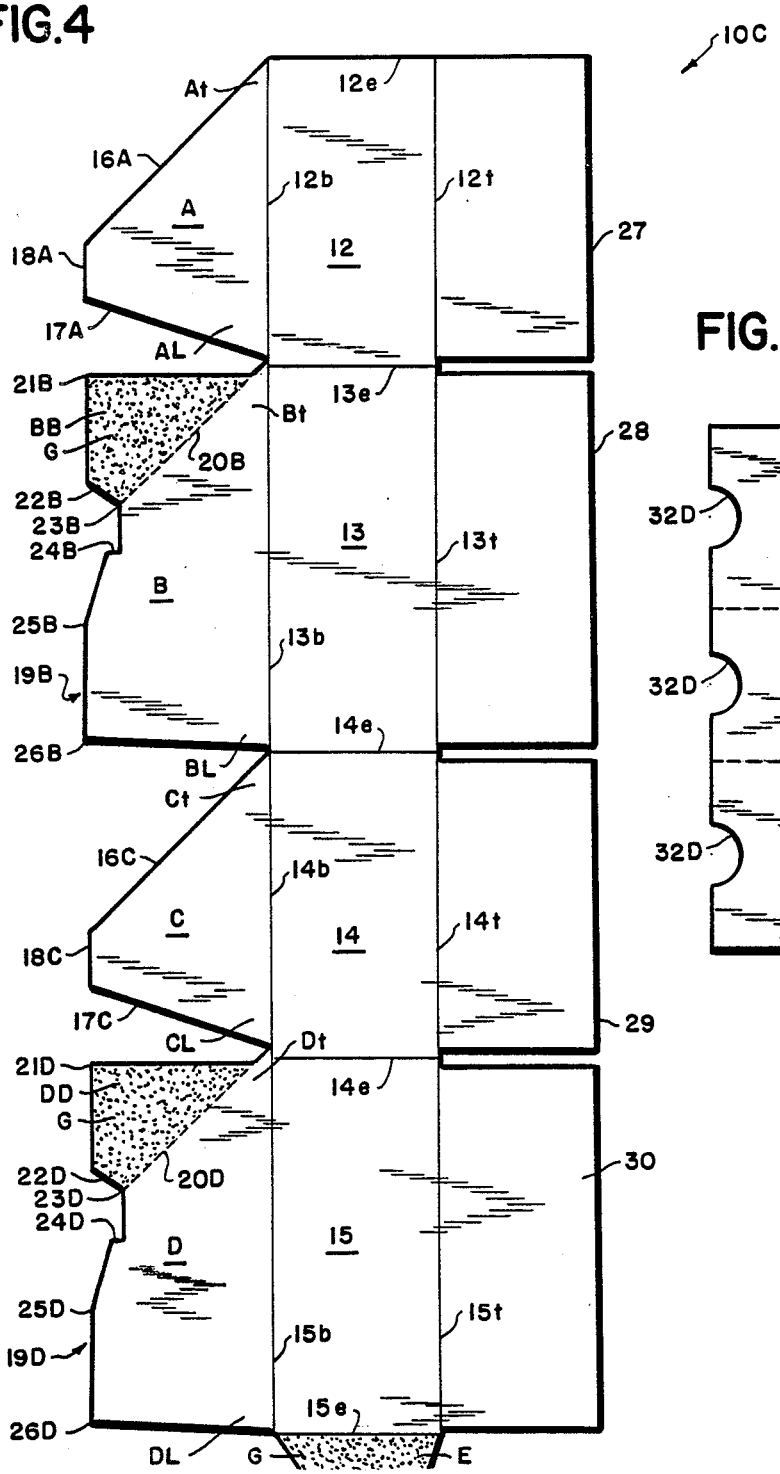
FIG. 4 is a top plan view of the blank used to make the box shown in FIGS. 1 and 3.

Referring now specifically to the FIGURES, in which identical or similar parts are designated by the same reference numerals throughout, a quick assembly and knock-down box in accordance with the present invention for use with an oil recycling or oil changing kit is generally designated by the reference numeral 10 in FIG. 1.

Referring to FIGS. 1, 2 and 3, the box 10 has side walls 12, 13, 14 and 15 which are generally rectangular as shown, and a bottom wall, generally designated by the reference numeral 10A which provides a closed bottom to an oil-receiving space or compartment 10B. The dimensions of the side walls are selected to define a generally rectangular space 10B which is consistent with the volume of oil to be received within the box.

The details of the quick assembly and knock-down box 10 will be described in more detail in connection with FIG. 4 which illustrates the blank 10C from which the box is made. The blank 10C includes a row of successively arranged generally rectangular first, second, third and fourth side walls 12–15, respectively. Adjacent ones of these walls are joined at generally transverse fold lines **13*e*–15*e*. Thus, adjacent side walls 12 and 13 are joined at transverse fold line or end edge 13*e*. Similarly, adjacent side walls 13 and 14 are joined at transverse fold line or end 14*e*, while side walls 14 and 15 are joined at transverse fold line or end edge 15*e***.

The side walls 12–15 are bounded by spaced parallel elongate fold lines normal to the transverse fold lines **12*e*–16*e*. One of these elongate fold lines forms bottom edges 12*b*–15*b*, while the other spaced parallel elongate fold line forms top edges or fold lines 12*t*–15*t*. As suggested, the lines 12*b*–15*b* are weakened or fold lines which form, in the assembled box, the bottom edges of the side walls 12–15, while the weakened or fold lines 12*t*–15*t* form, in the assembled box, the top edges of the side walls 12–15**.

The bottom wall 10A in FIGS. 1 and 3 is formed of first, second, third and fourth bottom panels A, B, C, and D connected to associated ones of the bottom edges **12*b*–15*b* of the side walls 12–15, respectively. The first bottom panel A and the third bottom panel C have substantially the same shape, configuration and dimensions, while the second bottom panel B and the third bottom panel D similarly have substantially the same configuration, shape and dimensions. The second bottom panel B and the fourth bottom panel D each have a connecting panel portion BB and DD, respectively, which are movable out of the planes of the respective second and fourth panels B,D along weakened or fold lines 20B and 20D, respectively. The second bottom panel B connecting panel portion BB is fixedly joined to the first bottom panel A, while the fourth bottom panel D connecting panel portion DD is fixedly joined to the third bottom panel C, as will be more fully described in connection with FIGS. 6–9**.

Each of the panels A and C have a substantially triangular shape and have their bases coextensive with and joined to associated bottom edges **12*b* and 14*b*, respectively, of associated side walls 12 and 14. Thus, the bottom panels A and C are each shown to have inclined edges 16A, 17A, and 16C, 17C, respectively. The triangular shapes are truncated at the outer ends, at 18A and 18C**, as shown.

The second and fourth bottom panels B and D each have a free edge 19B, 19D which is substantially parallel to an associated bottom edge 13B, 15B. Each connecting panel portion BB and DD is defined, as noted, by weakened or fold lines 20B, 20D extending from an intermediate point of a free edge 19B, 19D to that end of an opposing bottom edge 13B, 15B proximate to an associated first and third bottom panel A, C to which the connecting panel portion BB or DD is made. In the embodiments shown in FIG. 4, which is drawn to scale, the weakened or fold line 20B extends to the point of intersection of the fold lines and/or edges 17A, **12*b*, 13*e* and 13*b*. Similarly, the weakened or fold line 20D extends to the point of intersection between the lines and/or edges 17C, 14*b*, 15*e*, and 15*b***.

The connecting panel portions BB and DD are preferably provided with suitable adhesive G, for reasons which are described below.

Preferably, there is provided a further panel E, in the nature of a fastening flap or tab for attaching the first side wall 12 to the fourth side wall 15, at the respective end edges **12*e* and 16*e*. Where such additional flap or tap is provided, it is also provided with appropriate adhesive or glue G. It will be appreciated, however, that any other or suitable conventional connection means may be utilized to attach the side walls 12 and 15 to each other, at the edges 12*e* and 15*e***, including tape, staples, etc.

For purposes of reference, the free edge 19B of the panel B is shown as having one end 21B, and a remote opposing free end 26B. Intermediate these free ends, there is advantageously formed a notch defined by points 22B, 23B and 24B, which notch is located substantially mid-way between the free ends 21B and 26B. Between point 24B and 25B, there is shown an inclined or angled edge, which edge facilitates assembly and free movement and interlocking of the bottom panels B and D without mutual obstruction. The bottom panel D is similarly constructed.

Figure 5:
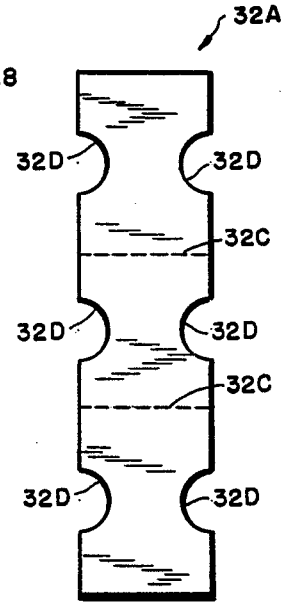
FIG. 5 is a top plan view of one of the baffle elements shown in FIGS. 1 and 3.

In the preferred embodiment, the baffle 32 is formed of two flat panels, as suggested in FIGS. 1 and 3. One of these panels 32A is shown in FIG. 5 to be in the nature of a generally elongate planar member having transverse weakened or fold lines 32C. Optional semicircular cut-outs 32D are provided on opposing sides, as shown, in each of the resulting portions after the panel is folded about the lines 32C.

The blank 10C is initially assembled by adhesively connecting the connecting panel portion BB to the bottom panel A and the connecting panel portion DD to the bottom panel C, and by adhesively attaching the fastening flap or tab E to the side wall 12, so as to bring the end edges 12*e* and 15*e* substantially coextensively to each other. This initial assembly places the bottom panels A-D substantially interiorly or inside of the substantially closed structure formed by the side walls 12–15.

Optional top wall flaps 27–30 are provided at each of the top edges 12*t*–15*t*. However, as will become evident to those skilled in the art, such top wall flaps 27–30 may be omitted, or less than 4 such panels or flaps may be used to close the resulting top opening in the box 10.

The initial assembly of the blank 10C, as aforementioned, permits, in the embodiment shown, the side walls 12 and 15, on the one hand, to be disposed in one plane, while side walls 13 and 14, on the other hand, are disposed in another proximate substantially parallel plane to form a substantially co-planar assembly in the knockdown condition of the box, as shown in FIG. 2.

Figure 6:
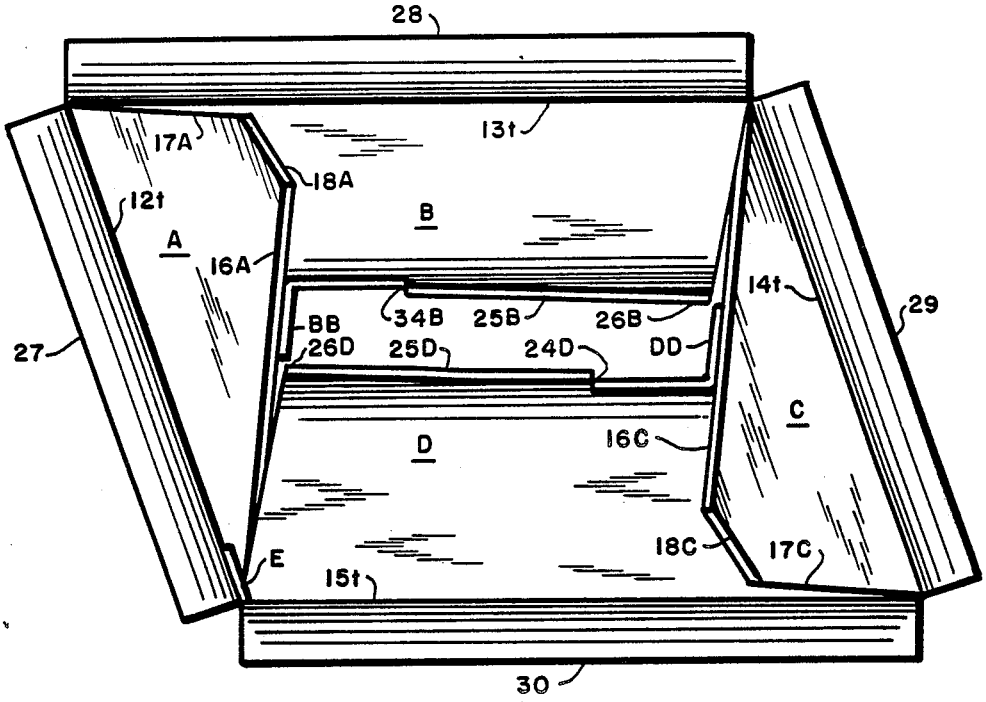
FIG. 6 is a top plan view of the box shown in FIGS. 1 and 3, formed from the blank shown in FIG. 4, and shown in an intermediate position during assembly.
Figure 7:
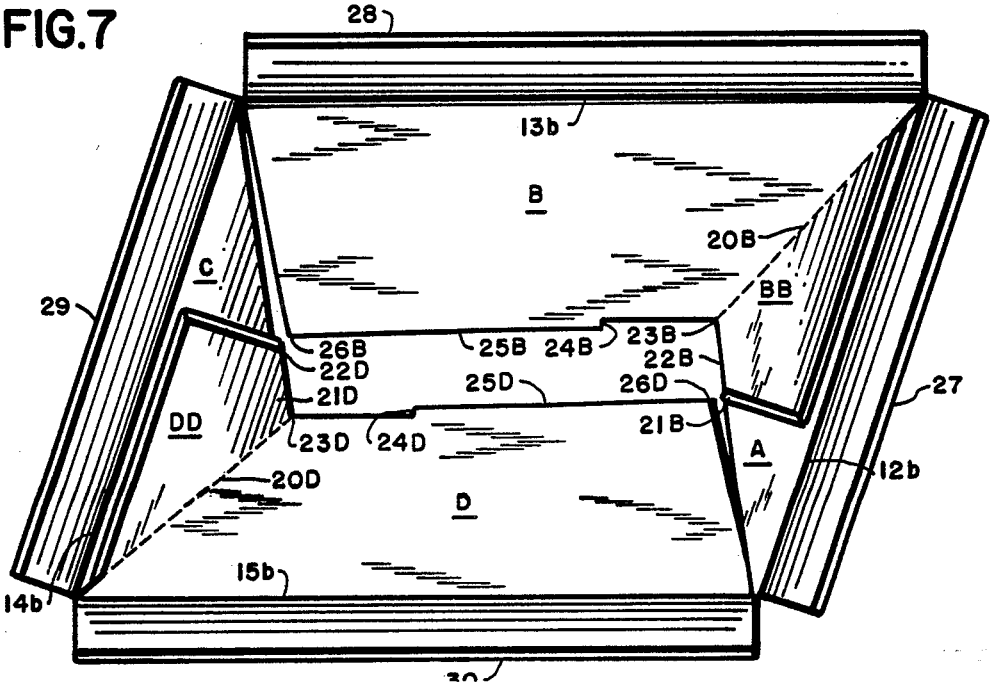
FIG. 7 is similar to FIG. 6, but showing a bottom plan view of the box.
Figure 8:
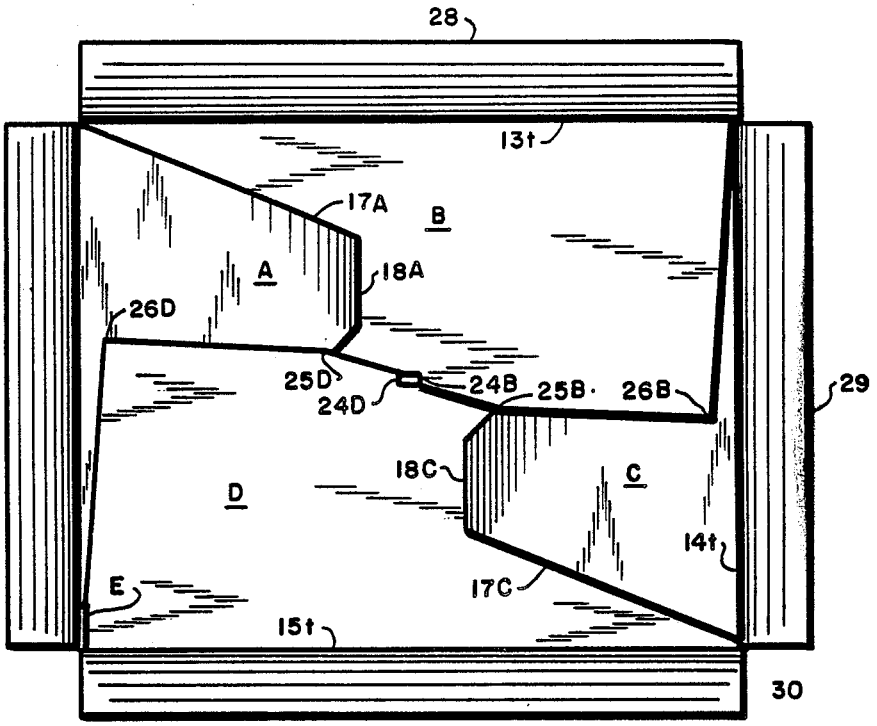
FIG. 8 is similar to FIG. 6, but showing the box in its fully assembled condition.
Figure 9:
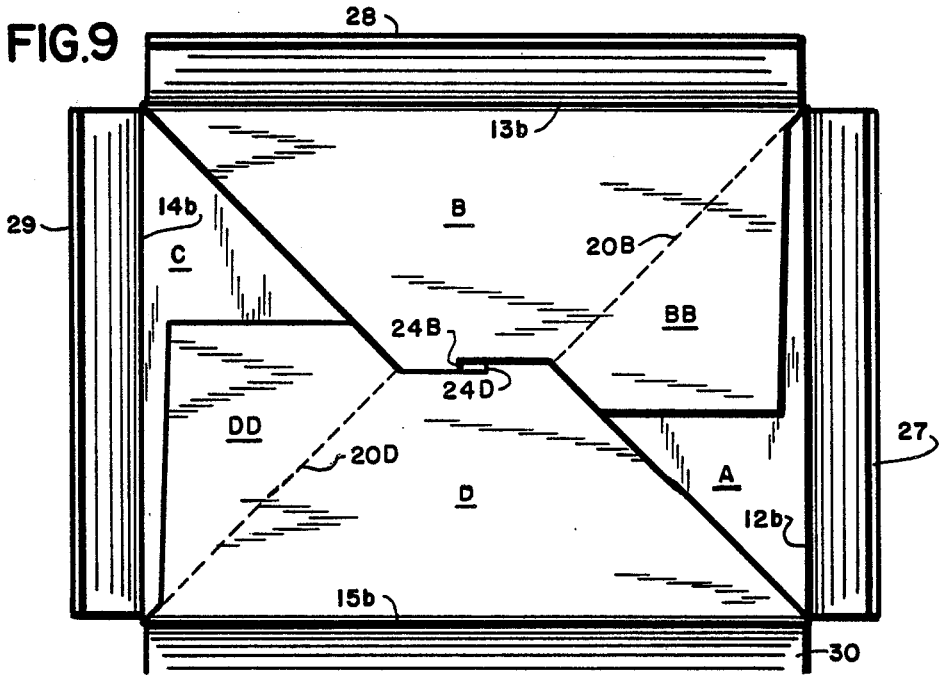
FIG. 9 is similar to FIG. 7, but is shown in the fully assembled condition.

During the quick assembly procedure, the respective side walls 12–15 are moved apart, as suggested in FIGS. 6 and 7. An important feature of the present invention is the attachment of the bottom panels A and B, on the one hand, and the panels C and D, on the other hand, by means of connecting panel portions BB and DD, respectively, which are movable out of the planes of the respective panels B and D, along the weakened or fold lines 20B and 20D. This construction insures that the opening of the box results in automatic unfolding of the bottom walls or panels A–D. For example, the movement of the bottom panel or wall B towards the right, in FIG. 6, pulls down the bottom panel A over the panel B. Similarly, the movement of the bottom panel D towards the left, as viewed in FIG. 6, automatically pulls the bottom panel C down over it. These relative movements of the panels, and the resulting unfolding of same, insures the synchronous opening of the respective bottom panels A–D and appropriate alignment and interlocking of these panels, whereby the bottom panels are interleaved and support and reinforce each other to rigidify the resulting bottom wall 10A. In FIGS. 8 and 9, the bottom panels A–D are shown in their final positions. In this connection, reference is again made to FIG. 4, wherein each of the panels A–D is shown to include trailing and leading portions, in the direction from the top of the Figure to the bottom of the Figure. Thus, the panel A has trailing portion $A_t$ and leading portion $A_1$. Similarly, panels B–D have trailing and leading portions $B_t$ and $B_1$; $C_t$, $C_1$; and $D_t$ and $D_1$, respectively. By virtue of the novel arrangement and interconnection of the bottom panels, each leading portion of each bottom panel overlaps and covers a trailing portion of a preceding adjacent bottom panel, while each trailing portion of each bottom panel overlaps and is covered by a leading portion of a succeeding adjacent bottom panel. In this manner, the rigidity and the supporting strength of the bottom wall is insured.

It will, therefore, be appreciated that, the box 10 can be easily and rapidly expanded, from its collapsed condition shown in FIG. 10 to its final configuration shown in FIGS. 1, 3, 8 and 9 by simply separating opposing parallel side walls of the box from each other.

Once the box has been fully expanded to the condition shown in FIG. 3, a heavy duty inside plastic bag 34 is placed into the box to line same. Any other oil or liquid impermeable material may be used for this purpose. The bag 34 provides a liquid impermeable surface which seals the oil-receiving space or compartment 10B. Thus, while the box 10 itself provides the rigidity, the inside bag 34 provides the liquid seal against escape of oil.

It is contemplated that the oil changing or recycling kit be provided with a baffle insert 32 which prevents excessive liquid movements or sloshing of the oil during handling of the box. The baffle 32, as shown in FIG. 3, to consist of two separate flat panels 32A and 32B which are identical. The details of such panels have been described in connection with FIG. 5. During assembly of the kit, each of the baffle panels are folded about the weakened or fold lines 32C to produce two similar U or V-shaped members which are placed back-to-back as shown in FIG. 1 so that the central or intermediate panel portions abut against each other, while the end portions or legs each deflect towards another corner of the box and are captured at the point where two side walls meet. This arrangement is self-locking, and requires minimal steps or effort in preparation for use.

Once the box is assembled, and the bag 34 and the baffle 32 are inserted, the engine oil can be drained, the old filter drained into the box 10, and the filter placed into the smaller bag 36. Both the inside and the filter bags 34, 36 can then be closed tightly, such as with the twist ties 38, and the bag brought to a local EPA recycling station or other suitable area designated for disposal of such hazardous waste materials.

While the invention has been disclosed with respect to specific embodiments, numerous alterations of the structure herein disclosed will be apparent to those ordinarily skilled in the art. The illustrated embodiments are only preferred embodiments of the invention which are given for purposes of illustration only and are not to be construed as a limitation of the invention as set forth in the claims.

What is claimed is:

1. An oil changing and recycling kit comprising a quick assembly and knock-down box comprising, in the assembled condition, first, second, third and fourth generally rectangular side walls each having a pair of spaced substantially parallel end edges and a pair of spaced substantially parallel top end bottom edges, adjacent side walls being connected to each other at associated end edges, said first and third side walls having substantially the same dimensions, and said second and fourth side walls having substantially the same dimensions, said side walls being arranged to define a generally rectangular space defined by spaced parallel first and third side walls which are substantially normal to spaced parallel second and fourth side walls; a bottom wall formed by first, second, third and fourth bottom panels connected to associated ones of said bottom edges of said first, second, third and fourth side walls, respectively, said first and third bottom panels having substantially the same dimensions and said second and third bottom panels having substantially the same dimensions, said second and fourth bottom panels each having a connecting panel portion movable out of the planes of respective second and fourth bottom panels along weakened lines, said second bottom panel connecting panel portion being fixedly joined to said first bottom panel and said fourth bottom panel connecting panel portion being fixedly joined to said third bottom panel, said top edges of said side walls defining an opening into said rectangular space, and said bottom panels being configured to form a substantially closed bottom wall in the assembled condition and to retract between said side walls in a collapsed condition of the box wherein each one of two pairs of two adjacent side walls are disposed in one of two proximate parallel planes to form a substantially co-planar assembly in the knock-down condition of the box; an inside bag for lining the interior of the box and providing a liquid seal to insure that oil received within said rectangular space is retained within said inside bag; and a baffle means within said rectangular space to limit liquid movements or sloshing within said box.

2. An oil changing and recycling kit as defined in claim 1, wherein said inside bag has an extended portion extending beyond said box opening, and further comprising a closure means for closing said inside bag after it is filled with oil.

3. An oil changing and recycling kit as defined in claim 2, wherein said closure means comprises a twist tie.

4. An oil changing and recycling kit as defined in claim 1, wherein said baffle means comprises at least one flat panel oriented in a plane parallel to said side walls and extending through the central region of said rectangular space.

5. An oil changing and recycling kit as defined in claim 1, wherein said baffle means comprises two back-to-back generally U-shaped members formed of planar portions arranged in planes parallel to said side walls.

6. An oil changing and recycling kit as defined in claim 1, further comprising a filter bag for disposal of oil filter, twist ties for said inside and filter bags.

7. An oil changing and recycling kit as defined in claim 6, further comprising a pair of protective gloves and hand cleaner.

* * * * *